US008016502B2

(12) United States Patent
Akatsu et al.

(10) Patent No.: US 8,016,502 B2
(45) Date of Patent: Sep. 13, 2011

(54) CUTTER DEVICE AND RECORDING APPARATUS

(75) Inventors: Shoji Akatsu, Shiojiri (JP); Eiji Kumai, Shiojiri (JP); Norihiro Yamashita, Shiojiri (JP); Yuta Tsukada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 445 days.

(21) Appl. No.: 12/361,927

(22) Filed: Jan. 29, 2009

(65) Prior Publication Data

US 2009/0196673 A1 Aug. 6, 2009

(30) Foreign Application Priority Data

Feb. 1, 2008 (JP) ..... 2008-022444

(51) Int. Cl.
*B41J 11/00* (2006.01)

(52) U.S. Cl. ..... 400/621; 400/611

(58) Field of Classification Search ..... 400/621
See application file for complete search history.

(56) References Cited

U.S. PATENT DOCUMENTS 3,686,991 A * 8/1972 Fujimoto ..... 83/482
4,313,359 A * 2/1982 Smoravek ..... 83/157
4,981,059 A * 1/1991 Kobayashi ..... 83/76.7
5,243,890 A * 9/1993 Ober ..... 83/471.2
5,363,123 A * 11/1994 Petersen et al. ..... 346/24
5,436,646 A * 7/1995 Schilling et al. ..... 346/139 R
5,503,053 A * 4/1996 Onishi et al. ..... 83/488
5,881,624 A * 3/1999 Brugue et al. ..... 83/485
6,454,475 B2 * 9/2002 Giles et al. ..... 400/621
7,815,382 B2 * 10/2010 Monclus et al. ..... 400/621
2007/0074614 A1 * 4/2007 Sobel et al. ..... 83/614

FOREIGN PATENT DOCUMENTS

JP 2002-226125 8/2002
JP 2003-260830 9/2003

* cited by examiner

*Primary Examiner* — Anthony H. Nguyen
(74) *Attorney, Agent, or Firm* — Workman Nydegger

(57) ABSTRACT

A cutter device includes a medium supporting surface that supports a recording medium being transported, and a cutter carriage that has a cutter blade for cutting the recording medium and that is movable in a direction perpendicular to the transport direction of the recording medium. An opening that forms a passage region for the cutter carriage is provided in the medium supporting surface so as to extend in the moving direction of the cutter carriage. The opening is provided with a cover capable of switching between a first state in which the cover covers the opening and forms part of the medium supporting surface and a second state in which the cover is retracted to form the passage region for the cutter carriage.

5 Claims, 6 Drawing Sheets

CUTTER DEVICE AND RECORDING APPARATUS

BACKGROUND

1. Technical Field

The present invention relates to a cutter device that cuts a recording medium and a recording apparatus having the cutter device.

2. Related Art

A printer is an example of a recording apparatus. Some printers have a cutting device that cuts paper at a predetermined position (see, for example, Japanese Patent No. 3654344 and JP-A-2003-260830). A cutter device includes a cutter carriage that has a cutter blade and that is movable in a direction perpendicular to the paper transport direction (that is, the paper width direction), and it performs cutting of paper by moving the cutter carriage from one side edge to the other side edge of paper positioned at a cutting position.

In some large printers (printers capable of recording on paper, for example, of A0 or B0 size of the JIS (Japanese Industrial Standards)), paper is transported while being sucked against a supporting surface that supports paper by means, for example, of vacuum suction. When a cutter device is provided in such printers, an opening that forms a passage region for a cutter carriage needs to be formed in the paper supporting surface.

However, when an opening that forms a passage region for a cutter carriage is formed, the front edge of paper can fall into this opening, and the paper can thereby float off the supporting surface on the upstream side of the opening and lower the printing quality. Or, the front edge of paper can be caught in the opening and cause a paper jam.

SUMMARY

An advantage of some aspects of the invention is to obtain a cutter device that can transport paper in an appropriate state while having an opening for forming a passage region for a cutter carriage in a paper supporting surface.

According to a first aspect of the invention, a cutter device includes a medium supporting surface that supports a recording medium being transported, and a cutter carriage that has a cutter blade for cutting the recording medium and that is movable in a direction perpendicular to the transport direction of the recording medium. An opening that forms a passage region for the cutter carriage is provided in the medium supporting surface so as to extend in the moving direction of the cutter carriage. The opening is provided with a cover capable of switching between a first state in which the cover covers the opening and forms part of the medium supporting surface and a second state in which the cover is retracted to form the passage region for the cutter carriage.

According to this aspect, the opening that forms a passage region for the cutter carriage is provided with a cover capable of switching between a first state in which the cover covers the opening and forms part of the medium supporting surface and a second state in which the cover is retracted to form the passage region for the cutter carriage. So, by bringing the cover into the first state at the time of non-cutting of the recording medium, the front edge of the recording medium can be prevented from falling into the opening. Thus, the trouble that the front edge of the recording medium falls into the opening, and the recording medium floats off the medium supporting surface on the upstream side of the opening and reduces the printing quality, can be prevented. In addition, a paper jam can also be prevented from occurring.

The cutter device may further include an urging unit that urges the cover to the first state, and at the time of cutting of the recording medium, the cutter carriage may press down the cover against the urging force of the urging unit, thereby switching the cover from the first state to the second state. In this case, it is not necessary to provide a dedicated drive source for switching between states of the cover, and switching between states of the cover can be performed with a simple configuration.

A guide member that guides the cutter carriage in its moving direction may be disposed outside the opening and opposite the medium supporting surface.

In this case, since a guide member that guides the cutter carriage in its moving direction is disposed outside the opening and opposite the medium supporting surface, it is not necessary to secure a space for the guide member around the opening, that is, a space for a unit that sucks the recording medium can be secured around the opening, and the recording medium can be reliably prevented from floating off the medium supporting surface.

When the cover is in the first state, the medium supporting surface formed by the cover may be located below the medium supporting surface on the upstream side of the cover.

In this case, when the cover is in the first state, the medium supporting surface formed by the cover is located below the medium supporting surface on the upstream side of the cover. So, when the recording medium has a curling tendency, the curling tendency can be absorbed with the step between the medium supporting surface formed by the cover and the medium supporting surface on the upstream side thereof, and the recording medium can be prevented from floating off the medium supporting surface and having a bad effect on the printing quality.

According to a second aspect of the invention, a recording apparatus includes a recording unit that performs recording on a recording medium, and the cutter device according to the first aspect, provided on the downstream side of the recording unit. According to this aspect, in a recording apparatus, the same advantageous effects as in the first aspect can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
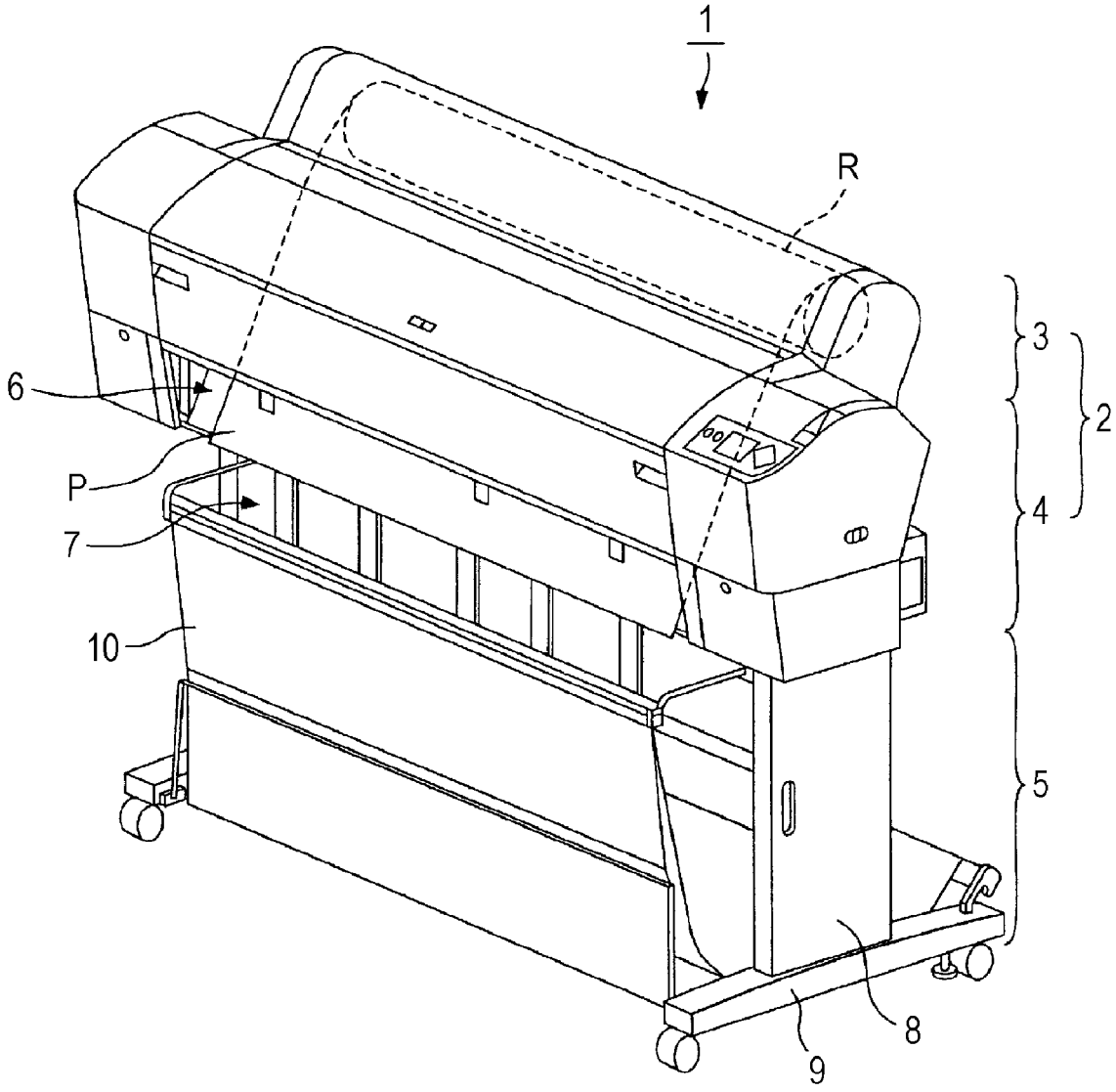
FIG. 1 is a perspective external view of a printer according to the invention.
Figure 2:
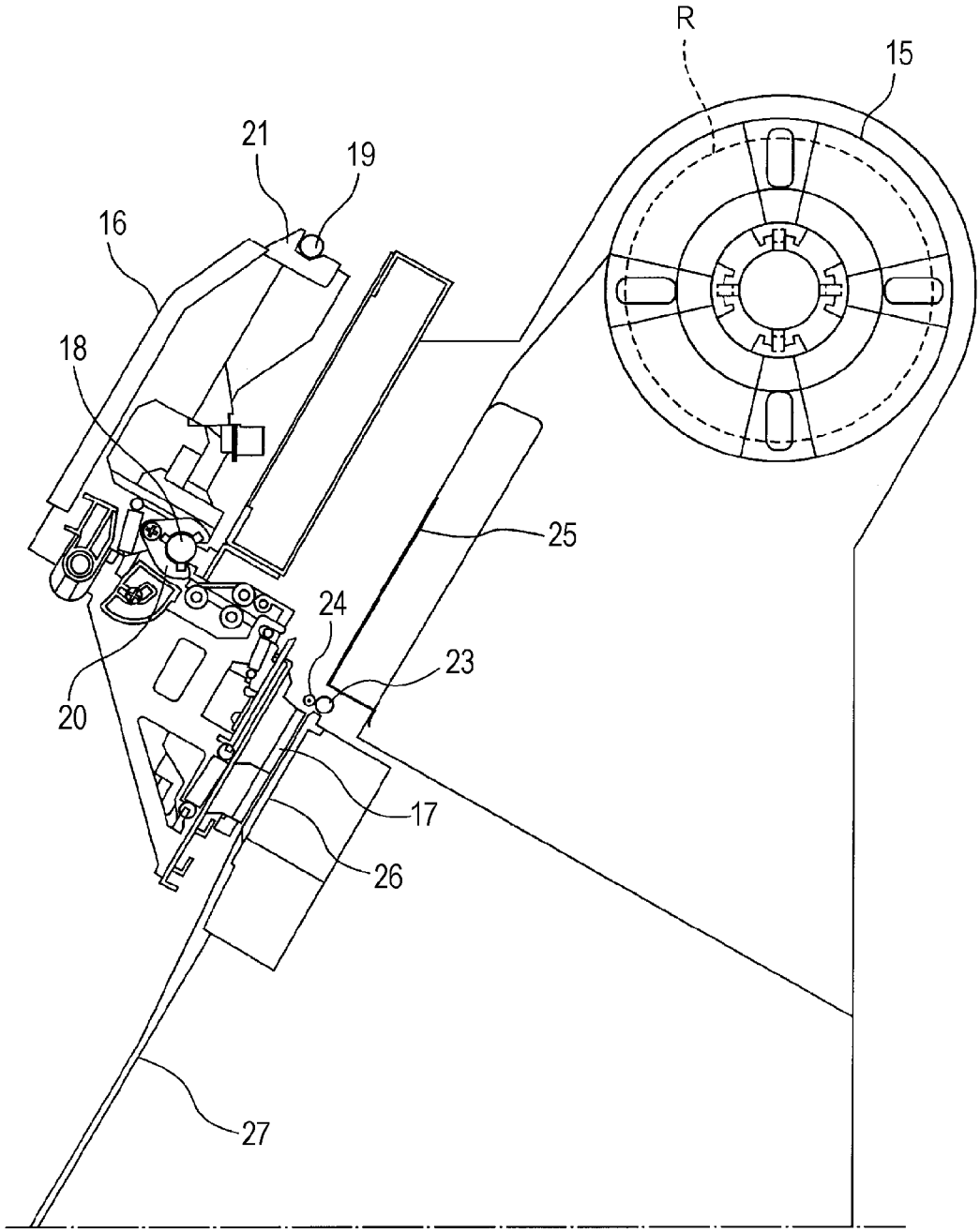
FIG. 2 is a partial side view of a printer according to the invention.
Figure 3:
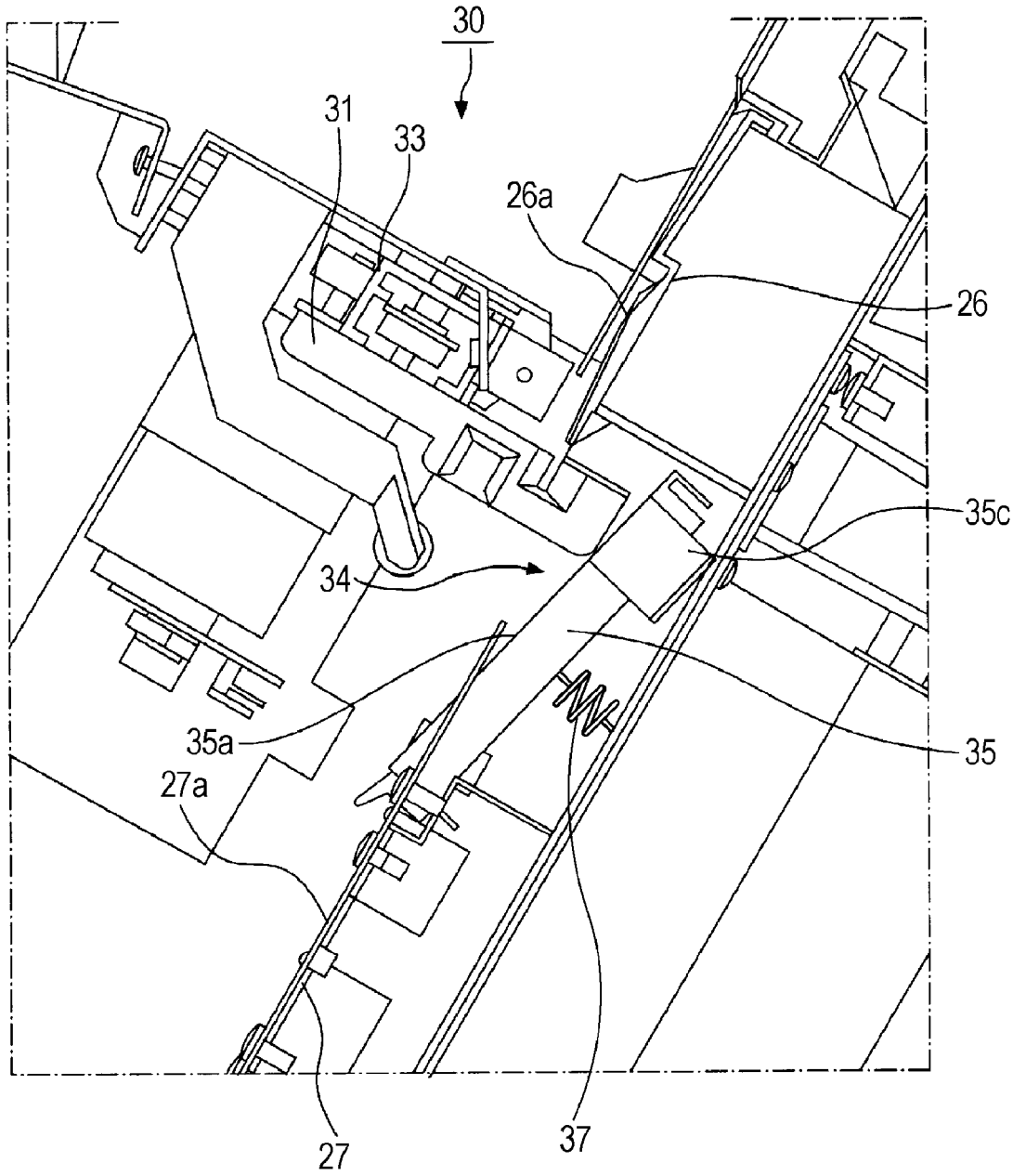
FIG. 3 is a side view of a cutter device according to the invention (a second state of a cover).
Figure 4:
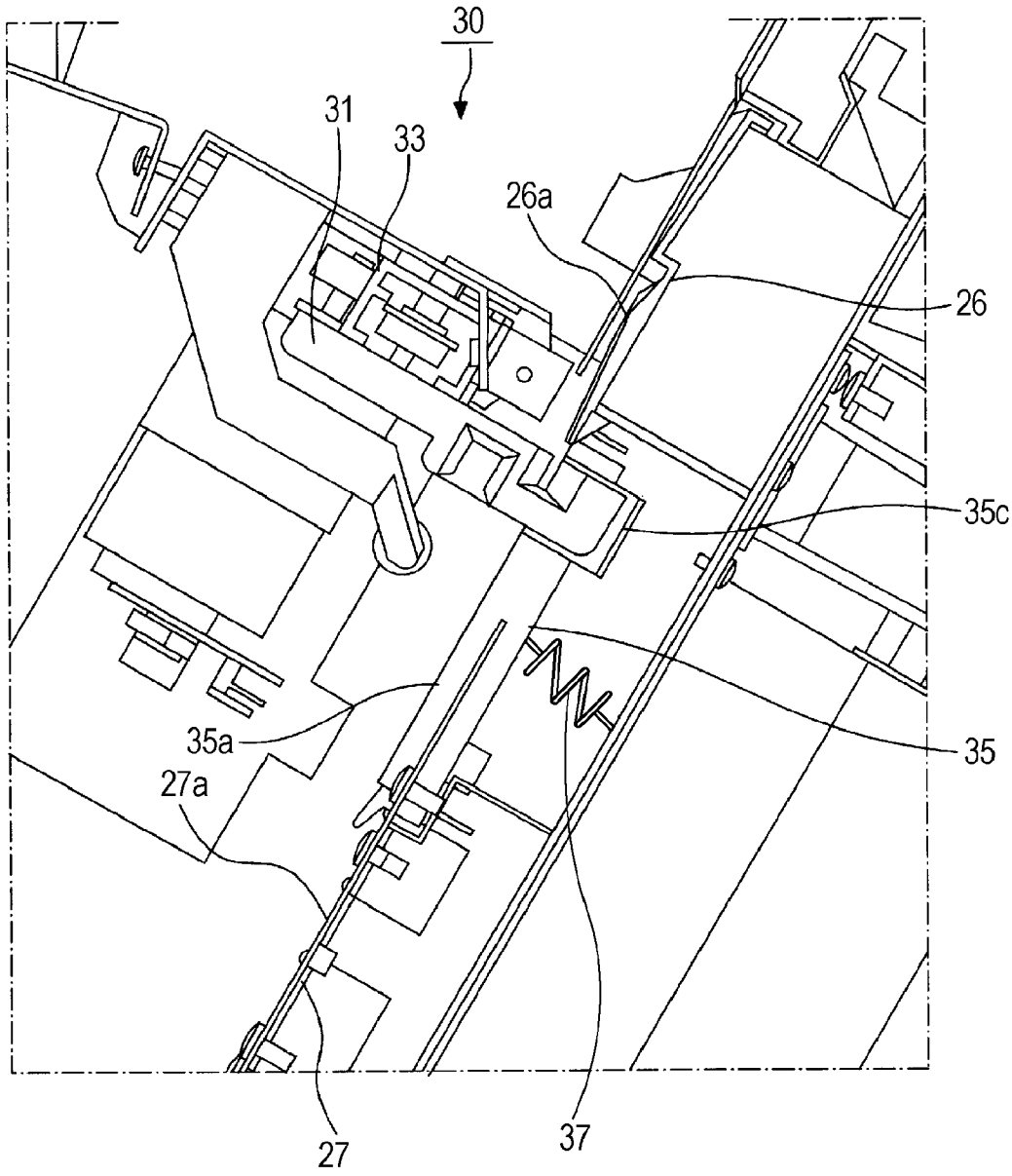
FIG. 4 is a side view of a cutter device according to the invention (a first state of a cover).
Figure 5:
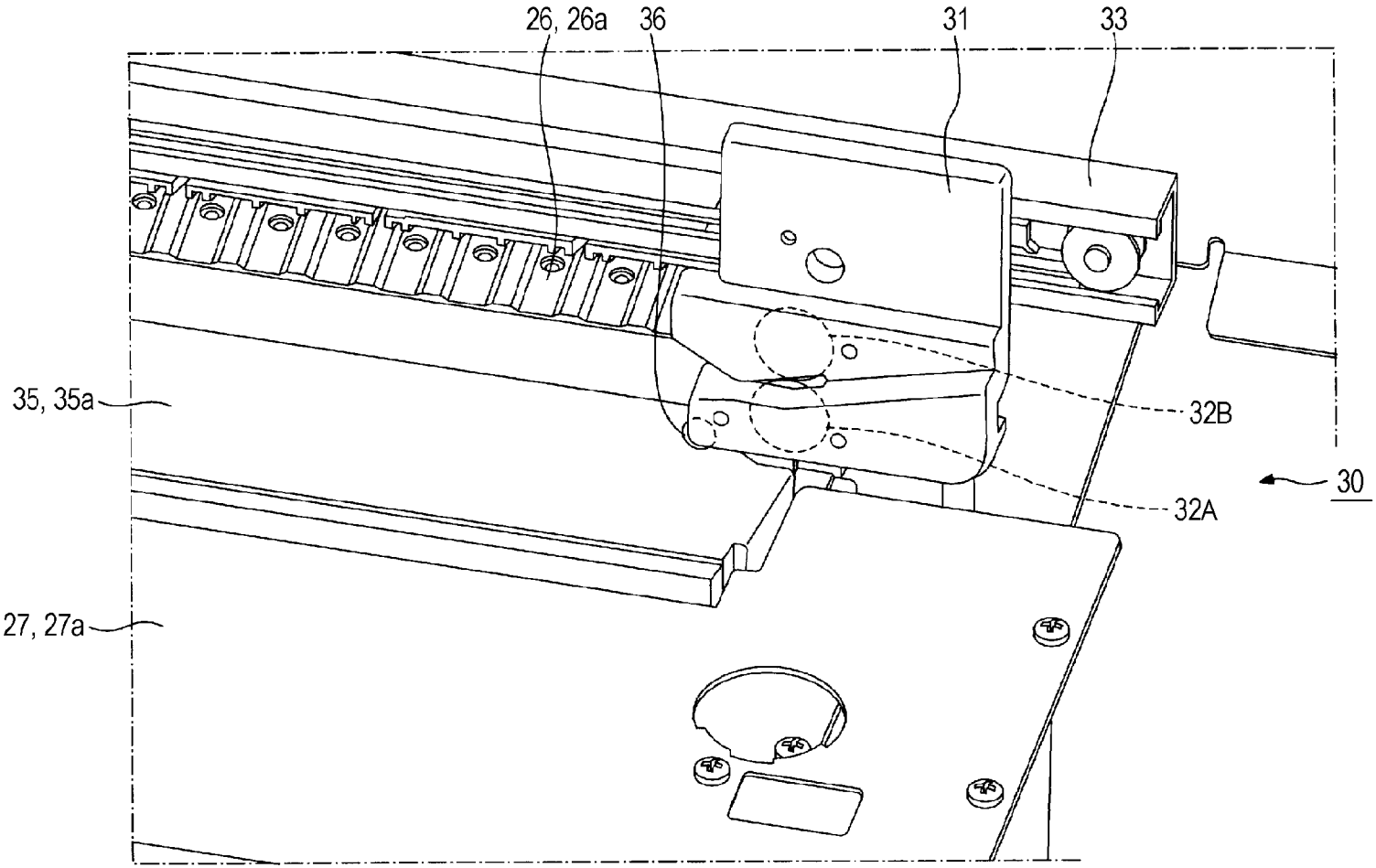
FIG. 5 is a perspective view of a cutter device according to the invention (a second state of a cover).
Figure 6:
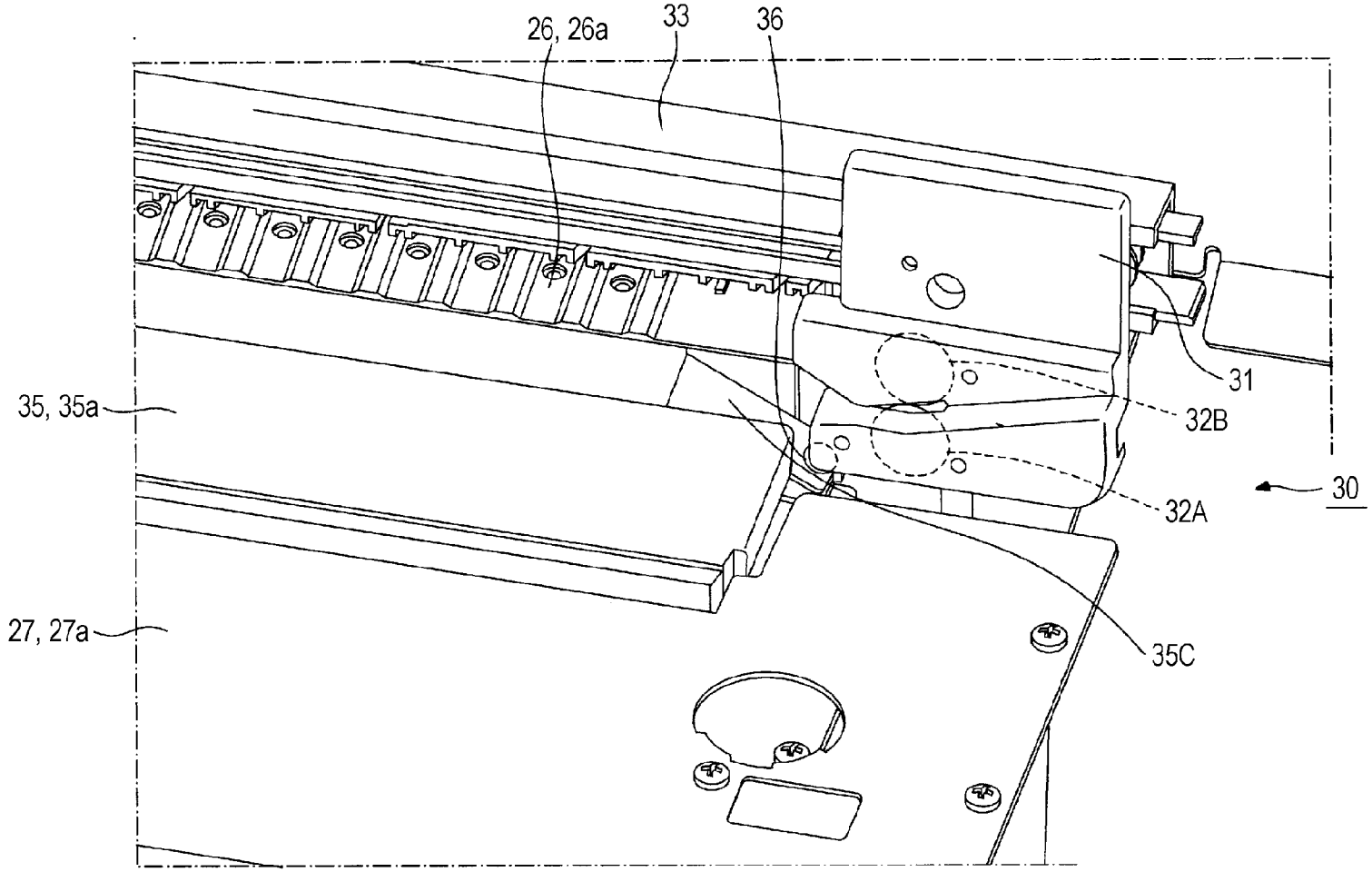
FIG. 6 is a perspective view of a cutter device according to the invention (a first state of a cover).

The embodiment of the invention will now be described with reference to FIGS. 1 to 6. FIG. 1 is a perspective external view of an ink jet printer (hereinafter referred to as "printer") 1 as an example of "recording apparatus" according to the invention. FIG. 2 is a partial side view thereof. FIGS. 3 and 4 are side views of a cutter device 30. FIGS. 5 and 6 are perspective views thereof.

First, with reference to FIGS. 1 and 2, the configuration of the printer 1 will be outlined. The printer 1 is a large printer capable of recording on roll paper (recording medium) P with a relatively large width, for example, of A0 or B0 size of the JIS (Japanese Industrial Standards), and it includes a main body 2 having a roll paper supply section 3 and a recording performing section 4, and a printout catcher section 5.

The main body 2 is provided on supports 8 stood on a base 9, and it has an exit 6 through which recorded roll paper P is discharged obliquely downward. Under the exit 6 is located an opening 7 of a stacker 10. Recorded roll paper P is discharged from the exit 6 to the opening 7 and is caught by the stacker 10.

The roll paper supply section 3 can house a roll of paper (hereinafter referred to as "roll") R. Roll paper P is unrolled from the roll R and is supplied obliquely downward to the recording performing section 4 that performs recording. In FIG. 2, reference numeral 15 denotes a roll paper holder. The roll paper holder 15 has a spindle (not shown) that is passed through a hollow core of a roll R, and flanges (the disc-like member in the figure) provided at both ends thereof. A roll R is set on this roll paper holder 15. At the time of supply of roll paper, the roll paper holder 15 is rotationally driven by a drive mechanism (not shown), and the roll paper P, guided by a guide member 25, is supplied to the recording performing section 4 on the downstream side.

The recording performing section 4 includes a recording head 17 that discharges ink onto the roll paper P, a guide member 26 that is disposed opposite the recording head 17, a transport drive roller 23 that is provided on the upstream side of the recording head 17 and transports the roll paper P to the downstream side, and a transport driven roller 24 that is pressed against the transport drive roller 23.

The recording head 17 is provided in the carriage 16. The carriage 16, being guided by guide shafts 18 and 19 extending in the scanning direction of the recording head 17 (the direction perpendicular to the paper plane of FIG. 2, hereinafter referred to as "main scanning direction") and being powered by a motor (not shown), reciprocates in the main scanning direction.

The carriage 16 is provided with bearings 20 and 21. The guide shaft 18 passes through the bearing 20, and the guide shaft 19 passes through the bearing 21. Thus, the carriage 16 is supported by the guide shafts 18 and 19.

On the downstream side of the recording head 17 is provided a paper suction section (not shown). On the downstream side of the recording head 17, the paper suction section prevents the roll paper P from floating, thereby preventing the reduction in recording quality due to the roll paper P floating. On the downstream side of the recording head 17 is provided a cutter device 30 (not shown in FIG. 2) that cuts the roll paper P.

The above is an outline of the configuration of the printer 1. The cutter device 30 will be described in detail with reference to FIGS. 3 to 6. The cutter device 30 includes a guide member 27 and cover member 35 that support the roll paper P being transported and guide it to the downstream side, a cutter carriage 31 that has cutter blades 32A and 32B and that can move in a direction perpendicular to the roll paper transport direction, and a guide member 33 that guides the cutter carriage 31.

The cutter blades 32A and 32B provided in the cutter carriage 31 are round blades in this embodiment, and they are rotatably supported in the cutter carriage 31. The disk surfaces of the cutter blades 32A and 32B overlap at their peripheries by a predetermined amount. So, when the cutter carriage 31 moves in its moving direction, the roll paper P is sheared between the cutter blades 32A and 32B.

Above the roll paper transport region is provided the guide member 33 that extends in a direction perpendicular to the roll paper transport direction (the direction perpendicular to the paper plane in FIGS. 3 and 4, hereinafter referred to as "roll paper cutting direction"). The cutter carriage 31, guided by the guide member 33 and powered by a motor (not shown), reciprocates in the roll paper cutting direction.

In this embodiment, when reciprocating, the cutter carriage 31 is controlled so as to turn at a position where the roll paper P is not off the cutter carriage 31. If, after the cutting of the roll paper P, the roll paper P particularly on the upstream side (the remaining side) comes off the cutter carriage 31, the cutter carriage 31 can collide with the roll paper P when it returns to the home position, thereby causing a paper jam.

So, the cutter carriage 31 is controlled so as to turn at a position where the roll paper P is not off the cutter carriage 31, thereby preventing a paper jam caused by a collision of the cutter carriage 31 with the roll paper P. Since the roll paper P need not be drawn back to prevent a collision between the cutter carriage 31 and the roll paper P after cutting, particularly when recording is performed without leaving margins at the four edges of the roll paper P, no misalignment occurs in the over-spray ink area, and so excellent recording results can be obtained.

The upper surfaces of the guide member 26 disposed opposite the recording head 17 and the guide member 27 on the downstream side thereof respectively form supporting surfaces 26*a* and 27*a* that support the roll paper P. Between them, an opening 34 for forming a passage region for the cutter carriage 31 is provided so as to extend in the roll paper cutting direction. This opening 34 is provided with a cover 35. The upper surface of the cover 35 serves as a supporting surface 35*a* that supports the roll paper P. The supporting surface 35*a* forms a continuous supporting surface that supports the roll paper P (hereinafter referred to as "roll paper supporting surface"), together with the supporting surface 26*a* on the upstream side and the supporting surface 27*a* on the downstream side.

The cover 35 is provided so as to be able to rock around a rocking shaft (not shown) provided on the downstream side of the cover 35. The cover 35 rocks, thereby switching between a first state (FIGS. 4 and 6) in which the cover 35 covers the opening 34 and forms part of the roll paper supporting surface, and a second state (FIGS. 3 and 5) in which the cover 35 is retracted to form the passage region for the cutter carriage 31.

The switching between the states of the cover 35 is performed by the urging force of a coil spring 37 serving as an urging unit and the depression of the cover 35 by the cutter carriage 31. That is, under the cover 35 is provided a coil spring 37 that urges the cover 35 to the first state. When the cover 35 and the cutter carriage 31 are not engaged with each other, the cover 35 is maintained in the first state by the action of the coil spring 37.

At one end of the cover 35 is formed a guide slope 35*c*. When the cutter carriage 31 moves to cut the roll paper from the home position (the position shown in FIG. 6) to the roll paper cutting side (leftward in FIGS. 5 and 6), the lower part of the cutter carriage 31 comes into contact with the guide slope 35*c*. When the cutter carriage 31 moves further, the cover 35 is pressed down against the urging force of the coil spring 37 and is brought into the second state in which the cover 35 opens the passage region for the cutter carriage 31 as shown in FIG. 3.

A roller 36 is provided at part of the cutter carriage 31 that engages with the cover 35. The roller 36 reduces the contact friction resistance between the cutter carriage 31 and the cover 35, thereby reducing the load on a motor (not shown) that drives the cutter carriage 31.

As described above, at the time of non-cutting of the roll paper P, the cover 35 is in the first state and forms a continuous roll paper supporting surface that supports the roll paper P together with the guide member 26 on the upstream side and the guide member 27 on the downstream side, and so the front edge of the roll paper P can be prevented from falling into the opening 34.

Thus, the trouble that the front edge of the roll paper P falls into the opening 34, the roll paper P floats off the guide member 26 on the upstream side of the opening 34, and the nonuniform distance to the recording head 17 lowers the printing quality, can be prevented. In addition, a paper jam can also be prevented from occurring. In addition, since switching between states of the cover 35 is performed without using a dedicated drive source for switching between states of the cover 35, switching between states of the cover 35 can be performed at a low cost.

Moreover, since the guide member 33 that guides the cutter carriage 31 in the roll paper cutting direction is disposed outside the opening 34 and opposite the roll paper supporting surface, vacuum suction ports for sucking the roll paper P can be disposed around the opening 34 (particularly in the guide member 26), and the reduction in recording quality due to the roll paper P floating off the guide member 26 can be reliably prevented.

Furthermore, when the cover 35 is in the first state, the supporting surface 35*a* of the cover 35 is located below the supporting surface 26*a* on the upstream side thereof, that is, a step is formed (the supporting surface 35*a* is one step lower than the supporting surface 26*a*). So, when the roll paper P has a curling tendency, the curling tendency can be absorbed with the step. So, it can be prevented that the roll paper P floats off the guide member 26 and the improper distance to the recording head 17 has a bad effect on the printing quality.

What is claimed is:

1. A cutter device comprising:

a medium supporting surface that supports a recording medium being transported; and a cutter carriage that has a cutter blade for cutting the recording medium and that is movable in a direction perpendicular to the transport direction of the recording medium, wherein an opening that forms a passage region for the cutter carriage is provided in the medium supporting surface so as to extend in the moving direction of the cutter carriage, and wherein the opening is provided with a cover capable of switching between a first state in which the cover covers the opening and forms part of the medium supporting surface and a second state in which the cover is retracted to form the passage region for the cutter carriage.

2. The cutter device according to claim 1, further comprising an urging unit that urges the cover to the first state, and wherein, at the time of cutting of the recording medium, the cutter carriage presses down the cover against the urging force of the urging unit, thereby switching the cover from the first state to the second state.

3. The cutter device according to claim 1, wherein a guide member that guides the cutter carriage in its moving direction is disposed outside the opening and opposite the medium supporting surface.

4. The cutter device according to claim 1, wherein when the cover is in the first state, the medium supporting surface formed by the cover is located below the medium supporting surface on the upstream side of the cover.

5. A recording apparatus comprising:

a recording unit that performs recording on a recording medium; and the cutter device according to claim 1, provided on the downstream side of the recording unit.

* * * * *